US006479941B1

(12) United States Patent
Abe et al.

(10) Patent No.: US 6,479,941 B1
(45) Date of Patent: Nov. 12, 2002

(54) ELECTROLUMINESCENT DEVICE AND METHOD FOR THE PRODUCTION OF THE SAME

(75) Inventors: Hidetoshi Abe, Tendo (JP); Yoshinori Araki, Sagae (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/787,938

(22) PCT Filed: Sep. 21, 1999

(86) PCT No.: PCT/US99/21915

§ 371 (c)(1),
(2), (4) Date: Jun. 4, 2001

(87) PCT Pub. No.: WO00/27169

PCT Pub. Date: May 11, 2000

(30) Foreign Application Priority Data

Oct. 30, 1998 (JP) ..... 10-310199

(51) Int. Cl.[7] ..... G09G 3/10

(52) U.S. Cl. ..... 315/169.3; 345/76; 313/494; 428/917; 428/690

(58) Field of Search ..... 315/169.3, 169.1; 313/494; 345/76; 428/917, 690

(56) References Cited

U.S. PATENT DOCUMENTS

| | | | | |
|---|---|---|---|---|
| 4,534,743 A | | 8/1985 | D'Onofrio et al. | 445/24 |
| 5,019,748 A | | 5/1991 | Appelberg | 315/169.3 |
| 5,045,755 A | | 9/1991 | Appelberg | 313/498 |
| 5,530,318 A | | 6/1996 | Ensign, Jr. et al. | 315/74 |
| 5,882,806 A | * | 3/1999 | Mori | 313/504 |
| 5,988,822 A | * | 11/1999 | Abe et al. | 359/536 |
| 6,166,856 A | * | 12/2000 | Araki et al. | 359/625 |
| 6,406,803 B1 | * | 6/2002 | Abe et al. | 313/498 |

FOREIGN PATENT DOCUMENTS

| | | |
|---|---|---|
| EP | 0 135 688 | 4/1985 |
| JP | 59-14878 | 1/1984 |
| JP | 62-59879 | 3/1987 |
| WO | WO 89/12376 | 12/1989 |
| WO | WO 98/53645 | 11/1998 |

OTHER PUBLICATIONS

E–Lite's Flatlite® Flat Lamps, E–Light Technologies, Inc., 18 pages.

* cited by examiner

*Primary Examiner*—Don Wong
*Assistant Examiner*—Tuyet T. Vo
(74) *Attorney, Agent, or Firm*—Carolyn A. Fischer

(57) ABSTRACT

An electroluminescent device having a transparent substrate extending in the lengthwise direction of the device, a transparent conductive layer placed on the back surface of the transparent substrate, a luminescent layer having a width smaller than the width of the transparent conductive layer and being placed on the back surface of the transparent conductive layer, a rear electrode placed on the back surface of the luminescent layer, and at least one buss which is placed on the part of the back surface of the transparent conductive layer having no luminescent layer, has a width smaller than the width of the transparent conductive layer, and is electrically in contact with neither the luminescent layer nor the rear electrode in which the transparent conductive layer, the luminescent layer, the rear electrode and the buss continuously extend in the lengthwise direction of the transparent substrate.

28 Claims, 1 Drawing Sheet

ELECTROLUMINESCENT DEVICE AND METHOD FOR THE PRODUCTION OF THE SAME

FIELD

The present invention relates to an electroluminescent device (hereinafter referred to as "EL device") and a method for the production of the same. In particular, the present invention relates to an EL device which can be produced and stored in the form of a roll as a stock product having a luminescent layer which continuously extends in the lengthwise direction of the roll-form device, unlike conventional EL devices produced by screen printing, and a method for the production of the same.

BACKGROUND

Luminescent layers and other layers of conventional EL devices are formed by silk-screen printing, as disclosed in JP-B-59-14878, JP-B-62-59879, etc. Thus, the size of the EL devices is limited by the size of a printing plate, and it is difficult to produce an EL device having a luminescent layer with a large area or which continuously extend in the lengthwise direction of the device. Also it is impossible to produce a roll-form EL device having a luminescent layer continuously extending in the lengthwise direction as a stock product.

When a stock product of an EL device having a continuous luminescent layer in the lengthwise direction can be produced and stored, an EL device having a required length can be obtained by cutting the stock product in a required length on demand, and the EL devices can be easily applied to various products. Thus, it is strongly desired to provide such a roll-form EL device.

Conventional EL devices are suitable for luminescent displays having a small plane size (small area) such as watches, pagers (beepers), portable phones, notebook-size personal computers, handy terminals, etc. but they cannot be used to assemble large-sized luminescent displays such as billboards, signs,. plane illuminators (e.g. floor illuminators, etc.), and the like.

If large-sized luminescence displays are assembled using conventional EL devices, a number of EL devices should be connected with each other, and thus, productions and construction of such displays are extremely difficult.

It is also important to increase the luminance of EL devices for the realization of large-sized luminescent displays. For example, the above cited patent publications disclose EL devices having a so-called "dispersion type luminescent layer" which is formed by dispersing luminescent particles such as fluorescent particles in matrix resins such as polymers having a high dielectric constant. For example, JP-B-S9-14878 discloses an EL device comprising a transparent substrate, a transparent conductive layer, an insulating layer consisting of a vinylidene fluoride polymer as a matrix resin, a fluorescent layer comprising fluorescent particles and a vinylidene fluoride polymer as a matrix resin, the same insulating layer as above, and a rear electrode, which are laminated in this order. JP-B-S9879 discloses an EL device comprising a polyester film, an ITO electrode, a luminescent layer comprising fluorescent particles and a cyanoethylated ethylene-vinyl alcohol copolymer (a matrix resin), and an aluminum foil (a rear electrode), which are laminated in this order. In these EL devices, a luminescent layer is formed by the application of a coating containing luminescent particles dispersed in a matrix resin. Thus, the luminance of the device can be increased by the increase of the amount of luminescent particles in the coating. However, the increase of the amount of the luminescent particles to an unnecessary level may make it difficult to apply the coating continuously at a high rate.

U.S. Pat. Nos. 5,019,748 and 5,045,755 disclose an EL device having a luminescent layer which is formed from (1) a first dielectric adhesive layer having a high dielectric constant applied on the transparent conductive layer of a transparent substrate, (2) a fluorescent particle layer in the form of a substantially single layer (having a thickness not exceeding the largest size of particles), which is formed by applying dry fluorescent particles (luminescent particles) on the first dielectric adhesive layer, and (3) a second dielectric layer containing a filler having a high dielectric constant. In contrast with the above "dispersion type luminescent layer", it is easy to continuously carry out the coating processes, and it is possible to produce a roll-form EL device by the disclosed method. However, these U.S. patent specifications do not disclose any specific manner to form a continuous terminal (buss), through which an electricity (voltage) is applied from outside to the transparent conductive layer, along the lengthwise direction of the transparent substrate, in the production steps of the roll-form EL device.

Furthermore, to increase the area of EL devices, it is a key factor that how a terminal (buss), which supplies an electricity (a voltage) to a transparent conductive layer from the outside, is provided. For example, in the case of EL devices for the above described displays with a small area, busses, which are not electrically in contact with luminescent layers or rear electrodes, can be formed on a transparent conductive layer by effectively repeating screen printing. However, none of the above cited publications or patents disclose any method to form busses continuously in the lengthwise direction of the device.

On the other hand, in the case of "dispersion type luminescent layers", it is difficult to form luminescent layers with improved luminance continuously at a high rate, that is, at a high productivity. The reason for this is that luminescent particles, which have a larger specific gravity than matrix resins, tend to sink in a coating for forming luminescent layers comprising luminescent particles dispersed in the solution of matrix resins, and thus it is difficult to uniformly disperse the luminescent particles in the luminescent layers formed from such a coating.

Furthermore, the dispersibility deteriorates when the amount of luminescent particles in the coating is increased to increase the filling rate of luminescent particles in the luminescent layer. The filling rate of the luminescent particles is at most 20 vol. % of the whole luminescent layer. In addition, it is relatively difficult to increase the coating thickness of the luminescent layer while maintaining the uniformity of a thickness using such a dispersion type coating. Therefore, the number of applications of the coating should be increased to increase the thickness of the luminescent layer for increasing the luminance, the productivity decreases, and it is difficult to produce a roll-form EL device having a large area.

There is a great need for an EL device which can be formed in the form of a roll, and from which large-sized luminescent displays can be easily produced, in order to solve the problems associated with the above-described prior arts. There is also a need for an EL device which can easily increase a filling rate the luminescent particles in a luminescent layer and thus improve the luminance of the device, in addition to the easy formation of large-sized luminescent displays. Also, there is a need for a roll-form EL device having a high luminance and a large area, which can be produced at a high productivity using no dispersion coating containing luminescent particles.

SUMMARY

In one embodiment, the present invention provides an electroluminescent device having a transparent substrate which extends in the lengthwise direction of the device; a transparent conductive layer placed on the back surface of the transparent substrate; a luminescent layer having a width which is smaller than the width of the transparent conductive layer and being placed on the back surface of the transparent conductive layer; a rear electrode placed on the back surface of the luminescent layer; and at least one buss which is placed on the part of the back surface of the transparent conductive layer having no luminescent layer, has a width smaller than the width of the transparent conductive layer, and is electrically in contact with neither the luminescent layer nor the rear electrode wherein the transparent conductive layer, the luminescent layer, the rear electrode and the buss continuously extend in the lengthwise direction of the transparent substrate.

In another embodiment, the present invention provides a method for producing an electroluminescent device including the steps of providing a transparent substrate on one surface of which a transparent conductive layer is applied; placing the luminescent layer on the transparent conductive layer by a coating process so that the width of the luminescent layer is smaller than that of the transparent conductive layer to form a luminescent layer carrying substrate; placing a masking on an exposed part of the transparent conductive layer of the luminescent layer-carrying substrate, which part has no luminescent layer, in the lengthwise direction of the transparent substrate, where the masking has a width smaller than that of the exposed part carrying no luminescent layer; and applying a conductive material onto the luminescent layer-carrying substrate to form the rear electrode and the buss which is electrically in contact with neither the luminescent layer nor the rear electrode due to the presence of the masking or the exposed part from which the masking is removed.

In another embodiment, the present invention provides a method for producing an electroluminescent device including the steps of: providing a transparent substrate on one surface of which a transparent conductive layer is applied; placing a masking on the surface of the transparent conductive layer to cover a buss-forming area, on which the buss is formed, with the masking, so that a buss-forming area having the applied masking and a masking-free area having no masking are formed on the transparent conductive layer; placing the luminescent layer on the masking-free area of the transparent conductive layer by a coating process to form a luminescent layer-carrying substrate; applying a conductive material onto the luminescent layer-carrying substrate to form the rear electrode on the luminescent layer; removing at least a part of the masking to expose the buss-forming area; and then applying a conductive material onto the exposed buss-forming area, to form the rear electrode and the buss which is electrically in contact with neither the luminescent layer nor the rear electrode due to the presence of the masking or the exposed part from which the masking is removed.

Furthermore, in another embodiment, the present invention provides an electroluminescent device, in which the luminescent layer includes: a transparent support layer comprising a matrix resin and being placed on the side of the transparent conductive layer; an insulating layer comprising an insulating material and being placed on the side of the rear electrode; and a luminescent particle layer having luminescent particle which are embedded in both the support layer and the insulating layer.

DETAILED DESCRIPTION OF THE PREFERRED EMBODIMENTS

Figure 1:
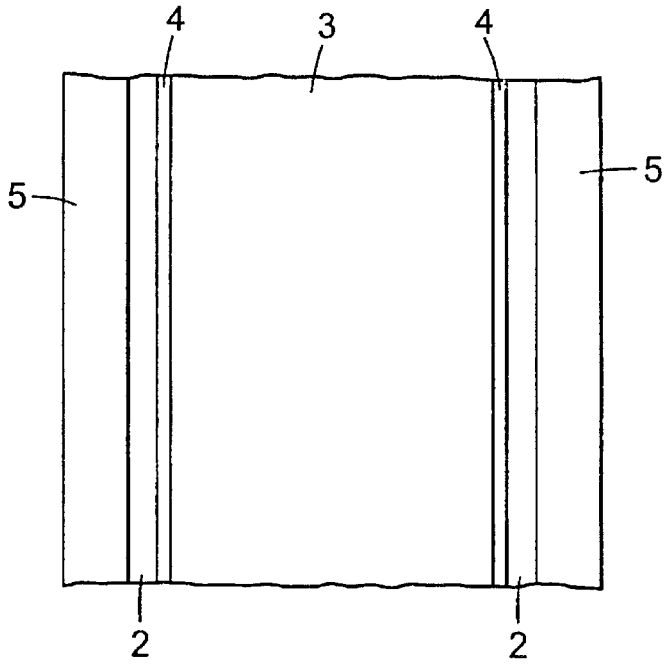
FIG. 1 illustrates a plane view of an EL device according to the present invention.

In suitable EL devices of the present invention, a transparent conductive layer, a luminescent layer, a rear electrode and a buss, which are placed on a transparent substrate extending continuously in the lengthwise direction, extend continuously in the lengthwise direction of the transparent substrate. Thus, the EL device comprising a luminescent layer and the like with a large area (plane size) which are continuous in the lengthwise direction can be very easily produced. That is, a roll-form EL device as a stock product having a luminescent layer which continuously extends in the lengthwise direction of the device is produced and stored, and an EL device having a desired length can be obtained by cutting the stock product in a desired length on demand.

Laminated parts (such as a luminescent layer, a buss and the like, which are formed on a transparent substrate), can be produced discontinuously by the conventional production method of EL devices using screen printing. However, only an EL device having a size such that the above discontinuous part is not included can be obtained from the stock product of EL devices produced by screen printing. On the other hand, when the EL device of the present invention is produced in the form of a roll as a stock product, the EL device can be easily applied to various products as explained above.

The luminescent layer of the EL device according to the present invention usually comprises luminescent particles (particles which emit light upon application of a voltage), and a matrix resin. For example, a luminescent layer can be formed by applying a coating containing a matrix resin and luminescent particles which are dispersed in the matrix resin on a substrate, and solidifying (drying, cooling, curing, etc.) it. Such a coating method can easily form a luminescent layer which continuously extends in the lengthwise direction.

Alternatively, a luminescent layer in the form of a substantially single particle layer can be formed using a coating (slurry) comprising a polymer having a high dielectric constant as a binder, and luminescent particles dispersed in the binder polymer. In this case, for example, a coated layer is made thin by applying the coating by curtain coating, etc. with little or no shear to form a luminescent particle layer consisting of the coated layer having substantially the same thickness as the particle size of the luminescent particles.

A roll-form EL device having high luminance and a large area can be produced at a high productivity, when the EL device is produced by a method comprising the following steps:

providing a transparent substrate on one surface of which a transparent conductive layer is applied, placing the luminescent layer on the transparent conductive layer by a coating process so that the width of the luminescent layer is smaller than that of the transparent conductive layer to form a luminescent layer carrying substrate, placing a masking on an exposed part of the transparent conductive layer of the luminescent layer-carrying substrate, which part has no luminescent layer, in the lengthwise direction of the transparent substrate, where the masking has a width smaller than that of the exposed part carrying no luminescent layer, and applying a conductive material onto the luminescent layer-carrying substrate to form the rear electrode and the buss which is electrically in contact with neither the luminescent layer nor the rear electrode due to the presence of the masking or the exposed part from which the masking is removed.

One of the characteristics of this method is that the rear electrode and buss can be formed so that the buss is electrically in contact with neither the luminescent layer nor the rear electrode due to the presence of (1) the masking or (2) the exposed part of the transparent conductive layer from which the masking has been removed, and on which no luminescent layer has been applied.

In this method, a masking may be removed if desired. It is not necessary to remove a masking insofar as a buss is not electrically in contact with a rear electrode. For example, a masking is not removed, when the first conductive material which forms a rear electrode and the second conductive material which forms a buss are applied at the same time but with different application apparatuses, or in different steps, and a masking prevents the rear electrode and the buss, which are formed from two conductive materials, from being in contact each other. Furthermore, a masking is not removed, when the thicknesses of a luminescent layer and a masking are sufficiently large in comparison with the thickness of a buss to be formed, and conductive materials, which are applied at the same time, can be separated between a buss-forming area and a rear electrode-forming area. However, a making is preferably removed, since a rear electrode and a buss, which are not electrically in contact each other, can be easily formed.

The first and second conductive materials may be the same or different. However, a buss and a rear electrode are preferably formed at the same time, since the production steps can be simplified, and the productivity increases.

In another embodiment of the present invention, a roll-form EL device having high luminance and a large area can be produced at a high productivity, when the EL device is produced by a method comprising the following steps:

providing a transparent substrate on one surface of which a transparent conductive layer is applied, placing a masking on the surface of the transparent conductive layer to cover a buss-forming area, on which the buss is formed, with the masking, so that a buss-forming area having the applied masking and a masking-free area having no masking are formed on the transparent conductive layer, placing the luminescent layer on the masking-free area of the transparent conductive layer by a coating process to form a luminescent layer-carrying substrate, applying a conductive material onto the luminescent layer-carrying substrate to form the rear electrode on the luminescent layer, removing at least a part of the masking to expose the buss-forming area, and then applying a conductive material onto the exposed buss-forming area, to form the rear electrode and the buss which is electrically in contact with neither the luminescent layer nor the rear electrode due to the presence of the masking or the exposed part from which the masking is removed.

One of the characteristics of this method is that a masking is applied on a transparent conductive layer prior to the application of a luminescent layer to form a bussforming area having the applied masking, and a masking-free area having no masking. This method can easily prevent the damage of the buss-forming area on the transparent conductive layer due to scratching, etc. from the step of the formation of a luminescent layer to the step of the formation of a buss. In this case, a masking makes it easy to form a continuous buss in the lengthwise direction of the substrate, and functions as a protective film of a transparent conductive layer (in the buss-forming area).

In this method, a masking is always removed, and it may be removed partly or wholly. For example, in the last listed step, the first conductive-material is applied on a luminescent layer-carrying substrate, and at least a part of the masking is removed to expose a buss-forming area. Then, the second conductive material is applied on the exposed buss-forming area to form a buss. Alternatively, when a part of the masking is removed and then the second conductive material is applied to the exposed buss-forming area, the remaining masking may be removed if necessary. Preferably, the whole masking is removed, since a rear electrode and a buss, which are not electrically in contact each other, can be easily formed. The first and second conductive materials may be the same or different.

When a masking is utilized as the protective film of a transparent conductive layer, preferably a part of the masking is removed in the last listed step to expose a buss-forming area, and then the conductive material is applied on the luminescent layer-carrying substrate to form, at the same time, a rear electrode and a buss which is electrically in contact with neither the luminescent layer nor the rear electrode, since the rear electrode and the buss, which are not electrically in contact with each other, can be particularly easily formed, and thus the production steps can be simplified.

The above buss is preferably formed by any application method of a conductive material (e.g., application of a coating liquid, vapor deposition, sputtering, etc.). Thereby, a buss, which extends continuously along the lengthwise direction of the substrate, can be particularly easily formed in the production process of a roll-form EL device. Conductive materials, which are used to form a buss and a rear electrode will be explained below.

As a making material, repeelable adhesive tapes such as masking tapes, application tapes for sealing, etc., repeelable resin coatings, and the like, which are used in general coating methods, can be used. The thickness of a masking is usually from 10 to 100 $\mu$m. The preferable thickness of a masking is from 0.1 to 30 $\mu$m, when a making is used as the protective film of a transparent conductive layer (in a buss-forming area).

The filling rate of luminescent particles in a luminescent layer can easily increase, and thus luminance greatly increases, when a luminescent layer comprises a luminescent particle layer which substantially consists of particles containing luminescent particles, and is placed in-between a support layer and an insulating layer and in close contact with the two layers. At the same time, a luminescent layer continuously extending in the lengthwise direction can very easily be formed.

Such a luminescent layer comprising a support layer, an insulating layer, and a luminescent particle layer which is in close contact with the support layer and insulating layer can be formed by powder-application methods, for example, the scattering of luminescent particles, the details of which will be explained later.

An insulating layer and a support layer can be formed from coatings containing no luminescent particles. Thus, any problem due to the sink of luminescent particles in a coating for forming a luminescent layer does not arise, unlike the "dispersion type luminescent layer".

It is very easy to increase a filling rate of luminescent particles in a luminescent particle layer, and a filling rate of almost 100-vol. % can be achieved. An EL device comprising such a luminescent particle layer is preferable for the production of a roll-form EL device having a large area.

An EL device having such a luminescent particle layer is preferably produced by a method comprising the following steps:

providing a transparent substrate which is continuous in the lengthwise direction and carries a laminated transparent conductive layer on one of its surfaces, applying a coating for forming a support layer comprising a matrix resin on the transparent conductive layer so that the applied coating has a width smaller than the width of the transparent conductive layer, scattering particles containing luminescent particles over the coating in a layer state prior to the solidification of the coating, embedding the layer of particles partly in the coating, and solidifying the coating to form a support layer and a luminescent particle layer in close contact with the support layer, applying a coating for forming an insulating layer comprising an insulating material on the luminescent particle layer, solidifying the coating to form an insulating layer in close contact with the luminescent particle layer, and thus the luminescent layer comprising luminescent particles which are embedded in the support layer and insulating layer, whereby a substrate carrying a luminescent layer is obtained, placing a masking on the remaining part of the luminescent layer-carrying substrate where no luminescent layer has been formed, in the lengthwise direction of the transparent substrate, so that the width of the masking is smaller than that of the remaining part, applying a conductive material on the luminescent layer-carrying substrate, and optionally removing the masking to form, at the same time, a rear electrode provided on the insulating layer, and a buss which is electrically in contact with neither the luminescent layer nor the rear electrode.

The above method can easily form a luminescent layer having increased luminance continuously at a high rate, that is, at a high productivity. For example, the luminescent layer can be formed usually at a coating rate of 5 mpm (meter per minute) or higher, preferably between 110 and 200 mpm, more preferably between 12 and 100 mpm.

The content of luminescent particles in particles contained in the above luminescent layer is preferably at least 40 vol. %. When the content of luminescent particles is less than 40 vol. %, the effect to increase the luminance may deteriorate. The luminance is maximized when all the particles are luminescent particles. Therefore, the preferable content of luminescent particles is between 50 and 100 vol. %.

EL Device

Figure 2:
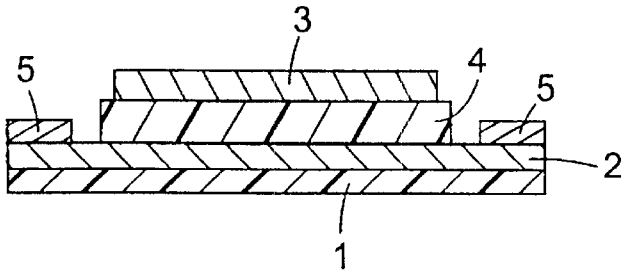
FIG. 2 illustrates a cross-section of an EL device according to the present invention.

One example of the EL device of the present is a roll-form EL device, which comprises, as shown in FIGS. 1 and 2, a laminate having a transparent substrate 1 and a transparent conductive layer 2, a rear electrode 3, a luminescent layer 4 placed between this laminate and the rear electrode 3, and at least one buss 5 that is placed on the transparent conductive layer and is electrically in contact with neither the luminescent layer nor the rear electrode.

In this structure, the busses 5 are placed near the both edges of the transparent substrate, and are in the form of two stripes which are in parallel with the luminescent layer 4 carrying the rear electrode.

The luminescent layer 4 of the preferable example shown in FIG. 3, which will be explained in detail below, has a structure in which a transparent support layer 41 comprising a matrix resin, an insulating layer 43 containing an insulating material, and a luminescent particle layer 42 placed between the layers 41 and 43, which are laminated in close contact.

In general, the thickness of the whole EL device is in the range between 50 and 3000 $\mu$m. The length of the EL device is usually at least 1 m, when it is in the roll-form.

The shape and arrangement of a buss are not limited to those described above, insofar as the buss functions as a terminal for supplying an electricity (voltage) to a transparent conductive layer from outside. For example, a buss may consists of a plurality of small buss parts which extend in the form of a bar code in the lengthwise direction, or a plurality of circular buss parts which are present along the length of the device. That is, small busses may discontinuously exist in the lengthwise direction, insofar as each distance between the adjacent buss parts is not too large.

For example, when an EL device for a large-sized display is formed by cutting a desired length from the stock product of an EL device, a luminescent layer should be present on a transparent conductive layer with no discontinuous part, while adjacent buss parts may be discretely present insofar as the buss parts can function as terminals for supplying an electricity (voltage) to a transparent conductive layer from the outside.

A buss may be formed from a conductive material by an application method, which can be employed also in the formation of a rear electrode. The application method is preferably the application of a coating containing a conductive material, vapor deposition, sputtering, etc., since a buss, which continuously extends along the lengthwise direction of a transparent substrate, can be easily formed in the production method of a roll-form EL device.

Transparent Substrate

The transparent substrate may be the same as that used in the conventional dispersion type EL devices, and for example, plastic films and the like can be used.

Examples of the plastic films used as substrates are films of polyester resins such as polyethylene terephthalate (PET), polyethylene naphthalate (PEN), etc.; acrylic resins such as polymethyl methacrylate, modified polymethyl methacrylate, etc.; fluororesins such as polyvinylidene fluoride, acryl-modified polyvinylidene fluoride, etc.; polycarbonate resins; vinyl chloride resins such as vinyl chloride copolymers; and the like.

The transparent substrate may be a single layer film as shown in FIG. 2, while it may be a multilayer film. For example, the whiteness of the light can increase, when at least one layer of the multilayer film has high transparency and contains a dye which develops a complimentary color to a color emitted by the luminescent layer. Preferably, examples of such the dye are red or pink fluorescent dyes such as rhodamine 6G, rhodamine B, perylene dyes, etc. when the emitted light from the luminescent layer is blue-green. Furthermore, processed pigments comprising these dyes dispersed in resins may be used.

The both surfaces of the transparent substrate are usually flat, while the surface which is not in contact with the transparent conductive layer may have regular projections unless the effects of the present-invention are impaired.

The light transmission through the transparent substrate is usually at least 60%, preferably at least 70%, in particular at least 80%. Herein, the "light transmission" means the transmission of light measured using a UV-light/visible light spectrophotometer "U best V-560" (manufactured by NIPPON BUNKO KABUSHKISHA) with light of 550 nm.

The thickness of a transparent substrate is usually between 10 and 1000 $\mu$m when a roll-form EL device is formed.

A transparent substrate may contain additives such as UV light absorbers, moisture absorbents, colorants, fluorescent materials, phosphors, and the like unless the effects of the present invention are impaired.

Transparent Conductive Layer

A transparent conductive layer is placed on the back surface of the transparent substrate in close contact therewith.

The transparent conductive layer may be any transparent electrode which is used in the dispersion type EL devices such as an ITO (Indium-Tin Oxide) film, and the like. The thickness of the transparent conductive layer is usually between 0.01 and 1000 $\mu$m, the surface resistivity is usually between 500 Ω/square or less, preferably between 1 and 300 Ω/square. The light transmission is usually at least 70%, preferably at least 80%.

An ITO film is formed by any conventional film-forming method such as vapor deposition, sputtering, paste coating, and the like.

The ITO film is formed directly on the transparent substrate in the embodiment of FIGS. 1 and 2, while a primer layer may be formed on the transparent substrate, and then the ITO film may be formed on the primer layer. The thickness of a primer is usually between 0.1 and 100 $\mu$m. In place of the primer layer, the surface of the transparent substrate is treated with corona, the coating of silicon oxide, and the like for facilitating the adhesion of the ITO film. Alternatively, the ITO film is formed on a luminescence layer and then a transparent substrate is laminated on the ITO film.

Alternatively, an ITO film, which has been formed on the release surface of a temporary substrate, is transferred to the back surface of a transparent substrate through a transparent adhesive. As a temporary substrate, a release paper, a release film, a low density polyethylene film, etc. can be used.

Rear Electrode

A rear electrode layer is placed on the back surface of a luminescent layer, that is, the side facing an insulating layer. The rear electrode is in direct contact with the luminescent layer in the embodiment of FIGS. 1 and 2.

A resin layer can be provided between the rear electrode and the luminescent layer for increasing the adhesion between them. The resin for the resin layer may be a polymer having a high dielectric constant, which will be explained below. The resin layer may contain insulating organic particles.

A rear electrode may be a conductive material film used in the dispersion type EL devices such as a metal film of aluminum, gold, silver, copper, nickel, chromium, etc.; a transparent conductive film such as an ITO film, a conductive carbon film, and the like. Such a conductive material film is preferably formed by the application of a coating containing a conductive material (e.g. bar coating, spray coating, curtain coating, etc.), vapor deposition, sputtering, and the like. The metal film may be a vapor deposited film, a sputtered film, a metal foil, and the like. Also, an electrode film comprising a substrate (e.g. a polymer film, etc.) carrying a conductive layer can be used as a rear film.

The thickness of the rear electrode is usually between 5 nm and 1 mm.

The EL device can emit light from both surfaces when the rear electrode consists of a transparent conductive film and also the insulating layer is transparent.

Transparent Substrate (Support Layer)

As described above, a luminescent layer is preferably formed from a transparent substrate provided on the side of a transparent conductive layer, an insulating layer provided on the side of a rear electrode, and a luminescent particle layer containing luminescent particles which are embedded in both the support layer and insulating layer.

The support layer of the luminescent layer is placed preferably on the back surface of the transparent conductive layer in close contact therewith, and thereby the luminescent efficiency of the luminescent layer is easily increased.

The support layer is a transparent layer containing a matrix resin. The thickness of the support layer is usually between 0.5 and 1000 $\mu$m, and the light transmission is usually at least 70 preferably at least 80.

The matrix resin may be any matrix resin that is used in the luminescent layer of the conventional dispersion type EL devices, such as epoxy resins, polymers having a high dielectric constant, and the like. The polymers having the high dielectric constant are those having a dielectric constant of usually at least about 5, preferably between 7 and 25, more preferably between 8 and 18, when it is measured by applying an alternating current of 1 kHz. When the dielectric constant is too low, the luminance may not increase. When it is too high, the life of the luminescent layer tends to shorten.

Examples of the polymers having the high dielectric constant are vinylidene fluoride resins, cyanoresins, and the like. For example, the vinylidene fluoride resin may be obtained by copolymerization of vinylidene fluoride and at least one other fluorine-containing monomer. Examples of the other fluorine-containing monomer are tetrafluoroethylene, trifluorochloroethylene, hexafluoropropylene, and the like. Examples of the cyanoresin are cyanoethylcellulose, cyanoethylated ethylene-vinyl alcohol copolymer, and the like.

The support layer usually consists of a matrix resin, while it may contain additives such as other resins, fillers, surfactants, UV light absorbers, antioxidants, antifungus agents, rust-preventives, moisture absorbents, colorants, phosphors, and the like, unless the effects of the present invention are impaired. For example, the support layer may contain red or pink fluorescent dyes such as rhodamine 6G, rhodamine B, perylene dyes, and the like, when the emitted light from the luminescent particle layer is blue-green. Furthermore, the above other resins may be curable or tacky.

Insulating Layer

An insulating material contained in the insulating layer of the luminescent layer may be insulating particles, polymers having a high dielectric constant, and the like, which are used in the conventional dispersion type EL devices.

The insulating layer is usually a coating layer formed from a coating which has been prepared by dispersing the insulating particles in the polymer having a high dielectric constant, or the layer of a polymer having a high dielectric constant containing substantially no insulating particles.

Examples of the insulating particles are insulating inorganic particles of, for example, titanium dioxide, barium titanate, aluminum oxide, silicon oxide, silicon nitride, magnesium oxide, and the like. The polymers having a high dielectric constant may be the polymers used for the support layer.

The insulating layer may be formed by the application of a coating on either the rear electrode or the luminescent particle layer.

When the insulating layer is a coating layer comprising insulating particles and a polymer having a high dielectric constant, the amount of the insulating particles is between 1 and 400 wt. parts, preferably between 10 and 350 wt. parts, more preferably between 20 and 300 wt. parts, per 100 wt. parts of the polymer having the high dielectric constant. When the amount of the insulating particles is too low, the insulating effect decreases, and thus the luminance tends to decrease. When the amount is too high, the application of the coating may be difficult.

The thickness of the insulating layer is usually between 2 and 1000 $\mu$m. The insulating layer may contain additives such as fillers, surfactants, antioxidants, antifungus agents, rust-preventives, moisture absorbents, colorants, phosphors, curable resins, tackifiers, and the like, insofar as the insulating properties are not impaired.

Luminescent Particle Layer

Luminescent particles in a luminescent particle layer spontaneously emit light when they are placed in an alternating electric field. Suitable such particles include fluorescent particles which are used in the dispersion type EL devices. Examples of suitable fluorescent materials are single substances of fluorescent compounds (e.g. ZnS, CdZnS, ZnSSe, CdZnSe, etc.), or mixtures of the fluorescent compounds and auxiliary components (e.g., Cu, I, Cl, Al, Mn, $NdF_3$, Ag, B, etc.).

The average particle size of the fluorescent particles is usually between 5 and 100 $\mu$m. The particulate fluorescent materials, on which the coating film of glass, ceramics, and the like is formed, may be used.

The thickness of the luminescent particle layer is usually between 5 and 500 $\mu$m. When the fluorescent particle layer consists of a plurality of particles which are placed in a single layer state, the EL device can be made thin easily.

Furthermore, the luminescent particle layer may contain at least two kinds of luminescent particles. For example, at least two kinds of luminescent particles which emit blue, blue-green or orange light and have discrete spectra each other are mixed, and thus a luminescent layer having the high whiteness can be formed.

The luminescent particle layer may contain one or more kinds of particles other than the luminescent particles, for example, particles of glass, coloring materials, phosphors, polymers, inorganic oxides, and the like. For example, luminescent particles which emit blue-green light and a pink-coloring material which is the complimentary color to bluegreen (e.g. particles containing rhodamine 6G, rhodamine B, perylene dyes, etc.) are mixed for forming the luminescent layer having the high whiteness.

Formation of Luminescent Layer

The laminate structure of the luminescent layer comprising the support layer, luminescent particle layer and insulating layer may be formed as follows:

Firstly, the luminescent particle layer is formed on the surface of either the support layer or the insulating layer by any conventional powder coating method.

For example, particles containing the luminescent particles are scattered on the substrate layer while it maintains flowability, by a suitable method such as static suction, spraying, gravimetric scattering, and the like, and the luminescent particle layer in which a part or whole of the particles are embedded in the support layer is formed. After that, the flowability of the support layer is suppressed, and the support layer and the particle layer are bonded.

For maintaining the flowability of the support layer, following methods are preferable: A method for maintaining the undried state of the coating layer formed from the coating for the support layer containing the solvent, a method for maintaining the support layer at a temperature higher than the softening or melting point of the resin for the support layer, and a method for adding a radiation-curable monomer to the coating for the support layer. These methods make a solidifying procedure for suppressing the flowability of the support layer (drying, cooling or hardening) easy.

In the same way, the luminescent layer can be formed on the insulating layer made of the coating layer.

The final layer (either the support layer or the insulating layer) is laminated on the luminescent particle layer which has been formed as above, and the laminate structure in which the three layers are bonded is formed. The final layer is preferably laminated by coating a coating containing materials for forming the final layer and solidifying it, or by press-bonding a film made of materials for forming the final layer. These methods can surely form a bonded structure without the presence of any bubble at the interface between each pair of the support layer, luminescent particle layer and insulating layer.

Figure 3:
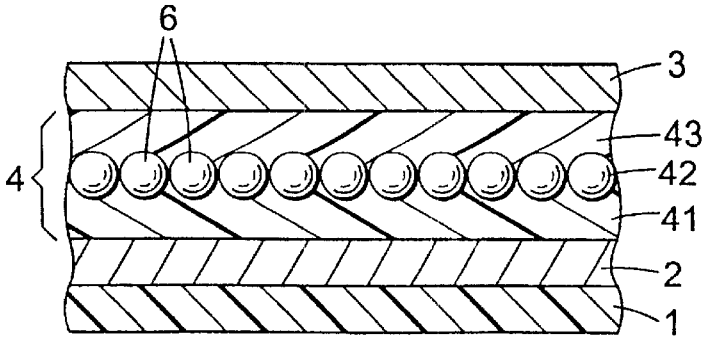
FIG. 3 illustrates a cross-section of one preferable example of a luminescent layer contained in an EL device according to the present invention.

The luminescent particle layer consists of a plurality of particles which are placed in a single layer state and is bonded to both the support and insulating layers, in the embodiment of FIG. 3. However, the luminescent particle layer may be a multilayer, or a part or whole of the particles may be embedded entirely in either the support layer or the insulating layer. It is important to form a bonded structure in which the luminescent particle layer is placed between the support layer and the insulating layer, and no bubbles are present at the interface between each pair of the layers.

In the luminescent particle layer formed as above, the materials of the support or insulating layer penetrate in spaces between the particles. In such a case, the filling rate of particles is usually at least 20 vol. %, preferably at least 30 vol. %, more preferably at least 40 vol. % since the decrease of the filling rate may lead to the decrease of luminance.

Herein, the "filling rate of particles" is defined as a percentage of the total volume of the particles in the volume of a hypothetical layer comprising all the particles in the luminescent particle layer and the materials which are present between the particles.

Furthermore, each of the support and insulating layers may be the laminate of two or more layers, unless the effects of the present invention are impaired.

A dispersion type luminescent layer may be formed as follows: a matrix resin comprising a polymer with a high dielectric constant, fluorescent particles, and a solvent are mixed and uniformly dispersed using a kneading apparatus such as a homo-mixer to obtain a coating for forming a luminescent layer. Then, the coating is applied and dried to form a luminescent layer. In this case, the coating may be applied directly onto a transparent conductive layer or a rear electrode, or a luminescent layer is once formed on a temporary support having releasing properties, and then transferred to a transparent conductive layer or a rear electrode.

The solid content of the coating is usually between 10 and 60 wt. %. The coating means, coating thickness, drying conditions, and the like are analogous to the formation of a conventional dispersion type luminescent layer.

Production of EL Device

Now, the production method of a laminated EL device comprising a laminated luminescent layer, which is one preferable embodiment of the present invention, will be explained.

Firstly, a transparent substrate, on which surface a transparent conductive layer has been laminated, is provided. A coating for forming a support layer is applied on the transparent conductive layer. After that, particles containing luminescent particles are scattered in a layer state over the applied coating prior to the drying of the coating, and the particle layer is partly embedded in the support layer, followed by the drying of the coating. These steps can easily form a luminescent particle layer which is partially embedded in and bonded to the support layer.

The particles are embedded in the support layer so that usually 1 to 99%, preferably 10 to 90%, more preferably 20 to 80% of the size of each particle in the vertical direction (to the plane of the support layer), for example, the diameter of a spherical particle, is embedded in the support layer. When the embedded percentage is less than 1% the particle layer tends to be damaged during the formation of an insulating layer. When the particles are embedded so that the embedded percentage exceeds 99%, the particle layer may not be formed uniformly. The support layer is generally formed so that it has a width smaller than that of a transparent conductive layer.

The coating thickness of the coating for forming the support layer is selected so that the dry thickness of the support layer is in the above range. The solid content in the coating for forming the support layer is usually between 5 and 80 wt. %. A solvent used in the coating is selected from conventional organic solvents so that the matrix resin is homogeneously dissolved.

The coating may be prepared with mixing or kneading apparatuses such as homo-mixers, sand mills, planetary mixers, and the like. For applying the coating, coating apparatuses such as bar coaters, roll coaters, knife coaters, die coaters, and the like can be used.

The drying conditions depend on the kind of solvent in the coating and the solid content of the coating, and usually include a temperature in the range between room temperature (about 25° C.) and 150° C., and a drying time in the range between 5 seconds and 1 hour.

The particles are scattered by the above method within 3 minutes from the application of the coating for forming the support layer, which makes the embedding of particles easy. The drying degree of the coating depends on the wetability between the particles and the support layer, that is, the easiness to embed the scattered particles into the undried support layer, and is usually in the range between 10 and 95 wt. %, preferably between 20 and 90 wt. % in terms of the solid content.

Subsequently, the coating for forming the insulating layer is applied so that the luminescent particle layer is covered, and dried. Accordingly, a bonded structure, in which the luminescent particle layer 42 is embedded in both the support layer 41 and the insulating layer 43, and no bubble is present at the interface between each pair of the layers, is formed, as shown in FIG. 3. In addition, a part having no luminescent layer remains on the transparent conductive layer.

The coating thickness of the coating for forming the insulating layer is selected so that the dry thickness of the insulating layer is in the above range. The solid content of the coating for forming the insulating layer is usually between 5 and 70 wt. %. A solvent used in the coating is selected from conventional organic solvents so that the insulating material is homogeneously dissolved or dispersed.

This coating may be prepared and applied using the same apparatuses or tools as those used for preparing and applying the coating for forming the support layer.

The drying conditions depend on the kind of solvent in the coating and the solid content of the coating, and usually include a temperature in the range between room temperature (about 25° C.) and 150° C., and a drying time in the range between 5 seconds and 1 hour.

Finally, the rear electrode is laminated on the insulating layer, while the buss is laminated on the part of the transparent conductive layer carrying no luminescent layer. The rear electrode may be formed by the above described methods. Among them, the methods for forming thin films in vacuum such as the vapor deposition and sputtering are preferable for effectively forming the rear electrode on the insulating layer, which has been dried, with good adhesion between the rear electrode and the insulating layer. The buss can be formed by the same methods as those employed in the formation of the rear electrode.

In general, the rear electrode is continuously formed over the whole back surface of a luminescent layer, as shown in the Figures. However, the rear electrode may be formed partly on the luminescent layer in accordance with objects. For example, a rear electrode can be formed in an image-wise manner. Thereby, the EL device can emit light to display an image. To achieve the same purpose, the luminescent layer may be formed repeatedly in the lengthwise direction to display a continuous image.

The steps of the above described production method are substantially the same as those of a conventional method for producing a roll-form product. Therefore, the roll-form EL devices having a high luminance and a large area can be produced at high productivity using the production steps for the conventional roll-form products. Furthermore, the problems caused by the use of dispersion coatings are solved, since the above method does not use the dispersion coatings of the luminescent particles unlike the production of the dispersion type EL devices.

The EL devices may be produced by an alternative method which may analogous to the above method, comprising applying the coating for the insulating layer on the support including the rear electrode, scattering the luminescent particles prior to the drying of the applied coating, embedding a part of the particle layer in the insulating layer, drying the coating for the insulating layer, applying and drying the coating for the support layer, then laminating the transparent substrate which carries the transparent conductive layer, and finally laminating the buss on the part of the transparent conductive layer carrying no luminescent layer. This method has the same effects as the above described method. In this case, the width of the rear electrode is smaller than that of the transparent conductive layer, and the buss is electrically in contact with neither the rear electrode nor the luminescent layer.

Application of EL Device

The EL device of the present invention can be used as a light source for large-sized displays such as internal-illuminating billboards, road signs, decorative displays, and the like.

For example, images such as characters, designs, and the like are printed on the surface of a light-transmitting sheet, and the sheet is placed on the EL device with the back surface of the sheet facing the light-emitting side of the EL device. The light-transmitting sheet may be made of the same material as that of the above transparent substrate, and has a light transmission of at least 20%. In this case, the back surface of the sheet and the light-emitting side of the EL device are preferably bonded each other. To this end, a light-transmitting adhesive is used. Examples of such the adhesive are pressure-sensitive acrylic adhesives, heat-sensitive acrylic adhesives, and the like.

Alternatively, an EL device built-in type display can be assembled by using a light-transmitting sheet as the above transparent substrate, forming the transparent conductive layer directly on the back surface of the light-transmitting sheet, and laminating the luminescent layer on the conductive layer.

Furthermore, a prism type retroreflective sheet may be used as the light-transmitting sheet (or the transparent substrate) The combination with the retroreflective sheet can impart both the retroreflectivity and the self-light-emitting properties to the EL device built-in type display.

Light is emitted from the EL device by connecting the buss on the transparent conductive layer and the terminal on the rear electrode layer to a power source, and applying a voltage to the EL device.

As the power source, cells such as dry cells, batteries, solar cells, etc. may be used, or an alternating current is supplied to the EL device from a power line through an inverter, which alters the voltage or frequency, or change the current between the alternating current and the direct current. The applied voltage is usually between 3 and 200 V.

The EL device of the present invention has the high light-emitting efficiency, and therefore emit light with sufficient luminance (for example, 50 cd/m$^2$ or higher) at a lower voltage (for example, 100 V or lower) than that necessary for the conventional dispersion type ones.

When the EL device is used outdoors, it is preferably covered with water-capturing films made of, for example, polyamide resins, or moisture-proof films made of, for example, polytetrafluoroethylene.

Any component layer of the EL device of the present invention, which is present in a light path from the luminescent particles, for example, a transparent substrate and a support layer may contain a colorant such as a dye or a pigment to adjust emitted light color. Furthermore, it is possible to provide, in a light path from the luminescent particles, a wavelength-conversion layer comprising a fluorescent dye, a fluorescent pigment, etc., which is excited with light from the luminescent particles and emits light having a wavelength different from that of the light from the luminescent layer. A component layer containing such a fluorescent dye or a fluorescent pigment, which is present in a light path from the luminescent particles, can be used as a wavelength-conversion layer.

EXAMPLES

Example 1

Production of EL Device

A roll-form laminated EL device having the structure of FIGS. 1 and 2 was produced in this Example.

An ITO/PET laminate film (trade name: TCF-KPC 300-75A manufactured by OIKE Industries, Ltd.) (thickness, 75 $\mu$m; light transmission, 81%) was used as a transparent substrate. The sizes of the film were 320 mm in width and 60 m in length. This film had the transparent conductive layer of ITO which had been laminated by sputtering on one surface of the film. The ITO layer has a thickness of 50 nm and a surface resistivity of 250 Ω/square.

The ITO layer surface of the above transparent substrate was coated with the solution of a polymer having a high dielectric constant (a tetrafluoroethylenehexafluoropropylene-vinylidene fluoride copolymer produced by 3M; trade name "THV 200 P" having a dielectric constant of 8 (at 1 kHz) and a light transmission of 96%) dissolved in the mixture of ethyl acetate and methyl isobutyl ketone (1:1) at a coating weight of 5 g/m$^2$, to form a continuous layer in the lengthwise direction of the film.

Just after the application of the solution, fluorescent particles (615A manufactured by Durel) were scattered with a spray coater (K-III Spray manufactured by NIKKA), and the solution layer was dried at 650° C. for about 1 minute, and then at 125° C. for about 3 minutes. Thus, a laminate was formed, which consisted of the layer of fluorescent particles in the form of a substantially single particle layer (luminescent layer) and a support layer which were in close contact with each other. The fluorescent particles were embedded so that about 30% of the diameter of each particle was buried in the support layer. The scattered amount of the fluorescent particles was about 65 g/m$^2$, and the thickness of the luminescent particle layer was 33 $\mu$m. Furthermore, the solution was coated so that an exposed part (non-coated part) of about 30 mm in width remained on each side of the ITO surface.

Next, a coating for forming an insulating layer was applied to cover the luminescent particle layer, and dried to form an insulating layer. Thereby, a bonded structure, in which the luminescent particle layer was embedded both in the support and insulating layers and substantially no bubbles were present at interfaces between each pair of layers, was formed. Thus, a luminescent layer-carrying transparent substrate, in which the luminescent layer continuously extended along the lengthwise direction, was obtained.

The composition of the coating for forming an insulating layer contained the above THV 200P, barium titanate, ethyl acetate and methyl isobutyl ketone in a weight ratio of 11:26:31:31. The coating was applied with a bar coater so that a coating weight after drying was 27 g/m$^2$, and dried under the same conditions as those in the case of the support layer. The total thickness of the luminescent layer was 36 $\mu$m after drying.

Then, an application tape for sealing (trade name: 2479H 7Y manufactured by 3M; a width of 18 mm) as a masking was adhered to each edge portion on the ITO film side of the luminescent layer carrying transparent substrate along the length of the substrate, with leaving an exposed surface having a width of about 5 mm on each side.

Finally, aluminum was vacuum deposited on the coated surface of the luminescent layering transparent substrate, that is, the surface having the luminescent layer, masking, and exposed ITO surfaces, and then the masking was removed. Thus, a rear electrode and two busses on both edge portions, all of which were made of aluminum, were formed at the same time. Accordingly, the roll-form EL device of the present invention was obtained.

The vacuum deposition of aluminum was carried out under a chamber pressure of $4\times10^{-2}$ to $6.66\times10^{-2}$ Pa (3.0 to 5.0 $10^{-4}$ Torr)at a line speed of 90 m/min. Non-deposited parts remained between the rear electrode and two busses and the busses were electrically in contact with neither the luminescent layer nor the rear electrode. The busses were stripe-form busses which continuously extended in the lengthwise direction and had no discontinuous parts.

Light emission from EL device

A rectangular EL device having plane sizes of 100 mm (length) and 320 mm (width) was cut out from the obtained roll-form EL device (stock product). Then, an alternating voltage of 100 V and 400 Hz was applied between the rear electrode and busses to illuminate the EL device. The luminance was 62 cd/m$^2$, and the luminous efficacy was 2.31 lm lumen)/W.

The alternative voltage was applied with a power supply (trade name: PCR 500L manufactured by KIKUSUI Electronic Industries, Ltd.) The luminance was measured as follows:

An EL device was placed in a dark room, and the luminance was measured at a distance of 1 meter from the surface of the transparent substrate using a luminance meter (LS 110 manufactured by MINOLTA).

Example 2

An EL device having a dispersion type luminescent layer was produced in this Example.

A dispersion coating for forming a luminescent layer was prepared so that the same polymer having a high dielectric constant (THV 200P) and the same fluorescent particles (615A) as those used in Example 1 were contained in a weight ratio of 1:3. Ethyl acetate was used as a solvent, and the solid content of the coating was 30 wt. %. This coating was applied on the ITO layer of the transparent substrate in the same manner as that for coating the support layer in Example 1 so that the dry thickness of the luminescent layer was 32 $\mu$m, and dried at 65° C. for about 3 minutes. Then, an insulating layer, a rear electrode and busses were formed in the same manners as in Example 1.

The voltage was applied and luminance was measured in the same manner as in Example 1. The luminance was 30 cd/m$^2$, and the luminous efficacy was 1.61 lm/W.

The complete disclosures of all patents, patent documents, and publications are incorporated herein by reference as if individually incorporated. It will be appreciated by those skilled in the art that various modifications can be made to the above described embodiments of the invention without departing from the essential nature thereof The invention is intended to encompass all such modifications within the scope of the appended claims.

What is claimed is:

1. An electroluminescent device, comprising:

a transparent substrate which extends in the lengthwise direction of the device, a transparent conductive layer placed on the back surface of the transparent substrate, a luminescent layer having a width which is smaller than the width of the transparent conductive layer and being placed on the back surface of the transparent conductive layer, a rear electrode placed on the back surface of the luminescent layer, and at least one buss which is placed on the part of the back surface of the transparent conductive lay having no luminescent layer, wherein the buss has a width smaller than the width of the transparent conductive layer and is electrically in contact with neither the luminescent layer nor the rear electrode, and wherein the transparent conductive layer, the luminescent layer, the rear electrode and the buss continuously extend in the lengthwise direction of the transparent substrate prior to cutting the device.

2. An electroluminescent device according to claim 1, wherein the luminescent layer comprises:

a transparent support layer comprising a matrix resin and being placed on the side of the transparent conductive layer, an insulating layer comprising an insulating material and being placed on the side of the rear electrode, and a luminescent particle layer having luminescent particles which are embedded in both the support layer and the insulating layer.

3. An electroluminescent device according to claim 2, wherein the luminescent particle layer composes a coated layer having substantially the same thickness as the particle size of the luminescent particles.

4. An electroluminescent device according to claim 2, wherein the matrix resin of the transparent support layer is selected from the group consisting of epoxy resins and polymers having a high dielectric constant.

5. An electroluminescent device according to claim 2, wherein the matrix resin of the transparent support layer is selected from the group consisting of epoxy resins and polymers having a dielectric constant of at least about 5 when measured by applying an AC current of 1 kHz.

6. An electroluminescent device according to claim 2, wherein the matrix resin of the transparent support layer is selected from the group consisting of epoxy resins and polymers having a dielectric constant of between 7 and 25 when measured by applying an AC current of 1 kHz.

7. An electroluminescent device according to claim 2, wherein the matrix resin of the transparent support layer is selected from the group consisting of polymers of vinylidene fluoride resins, and polymers of cyanoresins.

8. An electroluminescent device according to claim 2, wherein the transparent support layer has a thickness of between 0.5 and 1000 microns.

9. An electroluminescent device according to claim 2, wherein the transparent support layer contains red or pink fluorescent dyes.

10. An electroluminescent device according to claim 2, wherein the insulating layer comprises a coating containing insulating particles.

11. An electroluminescent device according to claim 10, wherein the insulating particles comprise an inorganic particle selected from the group consisting of titanium dioxide, barium titanate, aluminum oxide, silicon oxide, silicon nitride, and magnesium oxide.

12. An electroluminescent device according to claim 2, wherein the insulating layer is a coating layer comprising insulating particles and a polymer having a high dielectric constant and wherein the amount of the insulating particles is between 10 and 350 wt. parts per 100 wt. parts of the polymer having the high dielectric constant.

13. An electroluminescent device according to claim 2, wherein the luminescent particles are prepared using a material selected from the group consisting of ZnS, CdZnS, ZnSSe, and CdZnSe and mixtures of these materials with one or more auxiliary components selected from the group consisting of Cu, I, Cl, Al, Mn, $NdF_3$, Ag, and B.

14. An electroluminescent device according to claim 2, wherein the luminescent particle layer contains at least two kinds of luminescent particles.

15. An electroluminescent device according to claim 2, wherein the transparent substrate is a plastic film.

16. An electroluminescent device according to claim 1, wherein the transparent substrate is a film selected from the group consisting of polyethylene terephthalate, polyethylene naphthalate; acrylic resins; fluororesins; polycarbonate resins; and vinyl chloride resins.

17. An electroluminescent device according to claim 1, wherein the transparent substrate is a multilayer film.

18. An electroluminescent device according to claim 1, wherein the transparent substrate contains a dye which develops a complimentary color to a color emitted by the luminescent layer.

19. An electroluminescent device according to claim 18, wherein the dye is selected from the group consisting of red or pink fluorescent dyes.

20. An electroluminescent device according to claim 1, wherein the transparent substrate has a fight transmission at least 70% when measured using a spectrophotometer with light of 550 nm.

21. An electroluminescent device according to claim 1, wherein the transparent conductive layer is a Indium-Tin oxide film.

22. An electroluminescent device according to claim 1, wherein the transparent conductive layer has a surface resistivity between 500 Ω/square or less.

23. An electroluminescent device according to claim 1, wherein the tansparnet conductive layer has a surface resistivity between 1 and 300 Ω/square.

24. An electroluminescent device according to claim 1, wherein the rear electrode comprises a metal film of aluminum, gold, silver, copper, nickel, or chromium.

25. An electroluminescent device according to claim 1, wherein the device has a total thickness between 50 and 3000 microns.

26. An electroluminescent device according to claim 1, wherein the device is a roll-form device having a length of at least 1 meter.

27. A method for producing an electroluminescent device, comprising the steps of:

providing a transparent substrate on one surface of which a transparent conductive layer is applied, placing a luminescent layer on the transparent conductive layer by a coating process so that the width of the luminescent layer is smaller than that of the transparent conductive layer to form a luminescent layer carrying substrate, placing a masking on an exposed part of the transparent conductive layer of the luminescent layer-carrying substrate, which part has no luminescent layer, in the lengthwise direction of the transparent substrate, wherein the masking has a width smaller than that of the exposed part carrying no luminescent layer, and applying a conductive material onto the luminescent layer-carrying substrate, whereby forming a rear electrode thereon, and a buss that is electrically in contact with neither the luminescent layer nor the rear electrode due to the presence of the masking or the exposed part from which the masking is removed.

28. A method for producing an electroluminescent device, comprising the steps of:

providing a transparent substrate on one surface of which a transparent conductive layer is applied, placing a masking on the surface of the transparent conductive layer to cover a buss-forming area, on which a buss is formed, with the masking, so that a buss-forming area having the applied masking and a masking-free area having no masking are formed on the transparent conductive layer, placing a luminescent layer on the masking-free area of the transparent conductive layer by a coating process to form a luminescent layer-carrying substrate, applying a conductive material onto the luminescent layer-carrying substrate to form a rear electrode on the luminescent layer, removing at least a part of the masking to expose the buss-forming area, and then applying a conductive material onto the exposed buss-forming area whereby the rear electrode is formed and the buss is electrically in contact with neither the luminescent layer nor the rear electrode due to the presence of the masking or the exposed part from which the masking is removed.

* * * * *

UNITED STATES PATENT AND TRADEMARK OFFICE

CERTIFICATE OF CORRECTION

PATENT NO. : 6,479,941 B1
DATED : November 12, 2002
INVENTOR(S) : Abe, Hidetoshi It is certified that error appears in the above-identified patent and that said Letters Patent is hereby corrected as shown below:

Column 1,
Line 25, insert -- , -- following “also”.

Column 3,
Line 32, delete “layer carrying” and insert in place thereof -- layer-carrying --.

Column 5,
Line 43, insert -- with -- following “contact”.

Column 6,
Line 31, insert -- with -- following “contact”.

Column 9,
Line 15, delete “KABUSHKISHA” and insert in place thereof
-- KABUSHKIKAISHA --.

Column 16,
Line 63, delete “$4x10^{-2}$ to $6.66x10^{-2}$ following “of”.
Lines 63 and 64, delete (3.0 to 5.0 $10^{-4}$ Torr) and insert in place thereof
-- 3.0 to 5.0 $10^{-4}$ Torr --.
Line 64, insert hard return following “m/min.” so that “non-deposited” is a start of a new paragraph.

Column 17,
Line 10, delete “lumen)” and insert in place thereof -- (lumen) --.
Line 44, insert -- . -- following “thereof”.
Line 60, delete “lay” and insert in place thereof -- layer --.

UNITED STATES PATENT AND TRADEMARK OFFICE

CERTIFICATE OF CORRECTION

PATENT NO. : 6,479,941 B1
DATED : November 12, 2002
INVENTOR(S) : Abe, Hidetoshi It is certified that error appears in the above-identified patent and that said Letters Patent is hereby corrected as shown below:

Column 18,
Line 2, delete "prior to cutting the device" following "substrate".

Signed and Sealed this

Seventeenth Day of June, 2003

JAMES E. ROGAN
*Director of the United States Patent and Trademark Office*